US006616114B2

(12) United States Patent
Zahn et al.

(10) Patent No.: US 6,616,114 B2
(45) Date of Patent: Sep. 9, 2003

(54) FLEXIBLE BEARING BAR FOR ACCOMMODATING A SHEET PILE IN A SHEET-PROCESSING MACHINE

(75) Inventors: Erich Zahn, Eppelheim (DE); Michael Bantlin, Wiesloch (DE); Hans Butterfass, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/899,684

(22) Filed: Jul. 5, 2001

(65) Prior Publication Data

US 2002/0060398 A1 May 23, 2002

(30) Foreign Application Priority Data

Jul. 4, 2000 (DE) ..... 100 32 352

(51) Int. Cl.[7] ..... A47B 91/00
(52) U.S. Cl. ..... 248/346.01; 474/251; 108/57.21
(58) Field of Search ..... 414/795; 108/53.1, 108/54.1, 57.21, 57.22, 57.34, 901, 902; 248/346.01, 608, 609, 634; 474/250, 251

(56) References Cited

U.S. PATENT DOCUMENTS 2,348,522 A * 5/1944 Case ..... 474/251
3,059,887 A * 10/1962 Ward ..... 108/57.21
4,050,664 A * 9/1977 Daley ..... 108/901
5,127,620 A * 7/1992 Bleim et al. ..... 248/346.01
5,295,681 A * 3/1994 Blaser ..... 271/159
5,308,675 A * 5/1994 Crane et al. ..... 248/634

FOREIGN PATENT DOCUMENTS

DE 83 16 127.9 U1 12/1983
DE 42 11 353 A1 10/1993
DE 42 15 791 A1 11/1993
DE 44 24 287 A1 1/1996

* cited by examiner

*Primary Examiner*—David H. Bollinger
(74) *Attorney, Agent, or Firm*—Laurence A. Greenberg; Werner H. Stemer; Gregory L. Mayback

(57) ABSTRACT

A flexible bearing bar includes a flexurally soft tensile member carrying, on one side thereof, a multiplicity of compressive elements disposed successively in series and formed with respective contact surfaces, said tensile member being supportable on two supports, and said contact surfaces being subjectible to a load acting between said supports, from said compressive elements in a direction towards said tensile member for keeping said contact surfaces, respectively, in contact with one another.

22 Claims, 3 Drawing Sheets

FLEXIBLE BEARING BAR FOR ACCOMMODATING A SHEET PILE IN A SHEET-PROCESSING MACHINE

BACKGROUND OF THE INVENTION

Field of the Invention

The invention relates to a flexible bearing bar disposed, in particular, in an auxiliary sheet pile carrier for a pile change in a sheet-fed printing machine and is described, for example, in the published German Patent Document DE 42 11 353 C2 (which corresponds to U.S. Pat. No. 5,295,681). The flexible construction permits the bearing bar to be accommodated in a space-saving manner in a non-loaded, non-functional position within the sheet-fed printing machine. On the other hand, however, the bearing bar must have sufficient load-bearing capacity and dimensional stability in a predetermined, loaded load-bearing position, wherein it bears a residual pile during the pile change. The bearing bar is usually aligned rectilinearly in the load-bearing position, although it may also have, if necessary or desirable, a predetermined curvature, in the load-bearing position, which has to be maintained.

The conventional bearing bar is constructed as a chain with a multiplicity of chain links which are connected to one another via joints and, in a conventional manner, is deflectable and windable up in a direction to one side, while, with the chain in an outstretched alignment, the chain links are in contact with the front sides thereof and thus prevent deflection and winding up in the direction towards the other side. Load-bearing elements in the form of a chain which is flexurally stiff on one side have also become known heretofore from the published German Patent Documents DE 83 16 127 U1, DE 42 15 791 A1 and DE 44 24 287 A1, it being noted that, in the case of the last-mentioned document, a tensioning cable running along the chain is provided in order to stiffen the chain.

A bearing bar in the form of a chain, however, involves high outlay, in construction terms, because it is necessary to form a multiplicity of joints which connect the chain links to one another in an articulated and tension-resistant manner. Moreover, the chains are subject to a relatively high level of wear at the joints thereof, due to which the service life of the bearing bar is limited.

SUMMARY OF THE INVENTION

It is accordingly an object of the invention to provide a flexible bearing bar for accommodating a sheet pile in a sheet-processing machine, which is of straightforward construction and is subject to a minimal level of wear.

With the foregoing and other objects in view, there is provided, in accordance with the invention, a flexible bearing bar comprising a flexurally soft tensile member carrying, on one side thereof, a multiplicity of thrust elements disposed successively in series and formed with respective contact surfaces, the tensile member being supportable on two supports, and contact surfaces being subjectible to a load acting between the supports, from the thrust elements in a direction towards the tensile member for keeping the contact surfaces, respectively, in contact with one another.

In accordance with another feature of the invention, the tensile member is a belt.

In accordance with another feature of the invention, the thrust elements are formed integrally with the tensile member.

In accordance with a further feature of the invention, the thrust elements are fastened to the tensile member.

In accordance with an added feature of the invention, the thrust elements are fastened adjustably to the tensile member.

In accordance with an additional feature of the invention, the thrust elements are securable in different positions in a longitudinal direction of the tensile member.

In accordance with yet another feature of the invention, the bearing bar includes a tensioning device for bracing the thrust elements against one another.

In accordance with yet a further feature of the invention, the tensioning device has a tensioning cable extending through through-passages formed in the thrust elements.

In accordance with yet an added feature of the invention, the bearing bar includes a protective sheath for covering the thrust elements.

In accordance with yet an additional feature of the invention, the protective sheath is extensible.

In accordance with still another feature of the invention, the bearing bar includes a protective sheath for covering the tensile member.

In accordance with still a further feature of the invention, the protective sheath for the tensile member is extensible.

In accordance with still an added feature of the invention, the thrust elements engage with one another in a formlocking manner on the contact surfaces thereof.

In accordance with still an additional feature of the invention, the bearing bar includes an engagement part formed on one of the contact surfaces and engageable in a recess formed in another contact surface associated therewith.

In accordance with another feature of the invention, respective contact surfaces of the thrust elements located in a respective end region of the bearing bar are planar and are inclined so that the ends thereof which are directed towards the tensile member are closer to a center of the bearing bar than the ends thereof which are directed away from the tensile member.

In accordance with a further feature of the invention, those of the contact surfaces which are closer to a respective end of the bearing bar are inclined to a more pronounced extent than those of the contact surfaces which are farther away from the respective end.

In accordance with an added feature of the invention, those of the contact surfaces of the thrust elements located in a respective end region of the bearing bar are curved so that, as viewed from a bearing-bar end associated with the end region, in a position thereof wherein the tensile member forms an underside of the bearing bar, they are curved concavely downwardly from the top side of the bearing bar.

In accordance with an additional feature of the invention, the curved contact surfaces are inclined so that the ends thereof which are directed towards the tensile member are closer to a center of the bearing bar than the ends thereof which are directed away from the tensile member.

In accordance with yet another feature of the invention, those curved and inclined contact surfaces which are closer to a respective end of the bearing bar are inclined to a more pronounced extent than those which are farther away from the respective end.

In accordance with yet a further feature of the invention, the curved contact surfaces constitute lateral-surface sections of imaginary cylinders.

In accordance with a concomitant feature of the invention, 21. The bearing bar according to claim 20, wherein a respective one of the imaginary cylinders has a cylinder axis which is located at least approximately in a region of that side of the tensile member which is directed away from the thrust elements.

Thus, in order to achieve the foregoing object, the invention provides a flexible bearing bar having a flexurally soft tensile member which, on one side, carries a multiplicity of thrust elements which are arranged successively in series, are formed with contact surfaces and, with the tensile member being supported on two supports and with the contact surfaces being subjected to a load acting between the supports, from the thrust elements in the direction of the tensile member, are in contact with one another.

The invention provides a flexible bearing bar which, rather than being made up of a multiplicity of individual chain links, has a tension-resistant, but flexurally soft tensile member, in particular, in the form of a relatively flexible belt, for example, made of metal, which determines the deflection properties of the bearing bar. On that side on which compressive stressing is produced as a result of transverse loading, due to the sheet pile which is to be accommodated, the tensile member carries a plurality of thrust elements, which are arranged successively in series so that in the predetermined load-bearing position of the bearing bar, for example, in the outstretched or straightened-out position of the latter, they abut one another on mutually facing contact surfaces and are supported against one another, with compressive stressing building up in the process, with the result that deflection of the bearing bar is prevented. Deflection of the bearing bar under the aforementioned transverse loading in the opposite direction, in contrast, is possible because, in this case, the thrust elements do not abut one another. In this regard, the bearing bar is of straightforward construction, and pin joints, as are usually provided in a chain, are avoided altogether.

The tensile member and the thrust elements may be prefabricated as separate components and then connected to one another. It is possible, in this configuration, for the thrust elements to be applied to the tensile member by a releasable fastening, for example, of a screw-connection, thereby providing the advantage of adjustably retaining the thrust elements on the tensile member. It is possible, in particular, for the thrust elements to be securable in different positions in the longitudinal direction of the tensile member, as a result of which the compression-element contact surfaces, which come into abutment with one another, can be adjusted.

An alternative configuration may provide that the tensile member and the thrust elements be constructed as a one-piece or integral component. A development of this configuration may provide for the bearing bar to be constructed from a multiplicity of thin lamellae located beside one another, in which case each lamella includes a layer of the tensile member and of the thrust elements and can be cut out of a corresponding panel or plate. one-piece or integral component. A development of this configuration may provide for the bearing bar to be constructed from a multiplicity of thin lamellae located beside one another, in which case each lamella includes a layer of the tensile member and of the compressive elements and can be cut out of a corresponding panel or plate.

Other features which are considered as characteristic for the invention are set forth in the appended claims.

Although the invention is illustrated and described herein as embodied in a flexible bearing bar for accommodating a sheets pile in a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
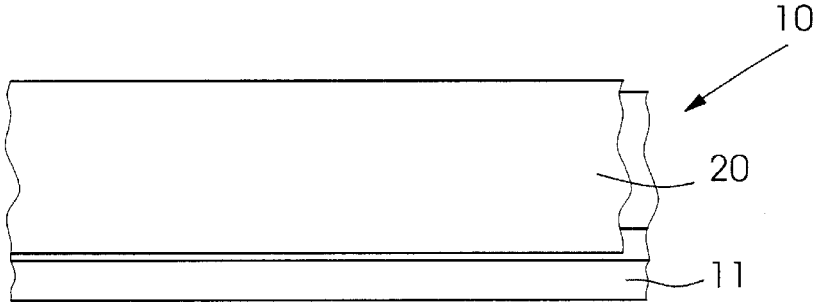
FIG. 1 is a fragmentary side elevational view of a bearing bar provided with a protective sheath, according to a first embodiment of the invention.
Figure 2:
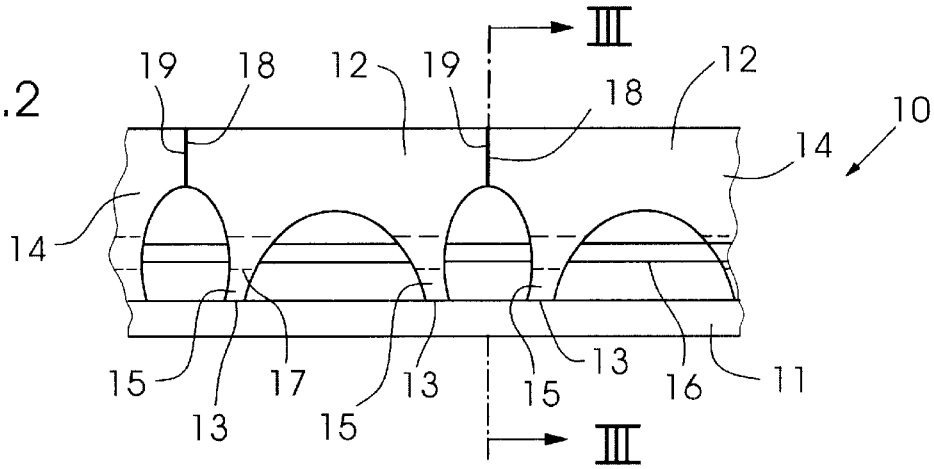
FIG. 2 is a view like that of FIG. 1, but with the protective sheath removed.
Figure 3:
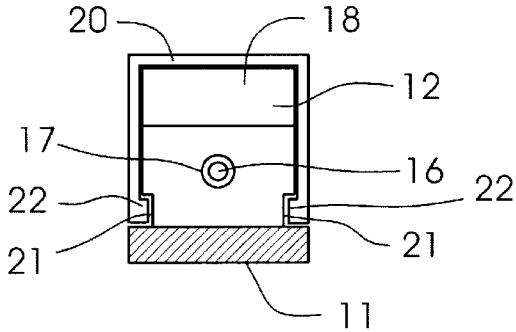
FIG. 3 is a cross-sectional view of FIG. 2 taken along the line the III—III in the direction of the arrows.

Referring now to the drawings and, first, particularly to FIGS. 1 to 3 thereof, there is shown therein a flexible bearing bar 10 according to a first embodiment of the invention having a flexurally soft, but tension-resistant tensile member 11, here constructed in the form of a belt, which, on a top side thereof, bears a multiplicity of rigid thrust elements 12 which are arranged successively in series in a longitudinal direction of the tensile member 11 and are fixedly connected, in sections 13, to the tensile member 11. The connections may be effected, for example, by welding, soldering, adhesive bonding or riveting. In a preferred configuration, the thrust elements 12 are connected integrally to the tensile member 11. Furthermore, the connection between the thrust elements 12 and the tensile member 11 is configured so that the tensile member 11 maintains the flexibility thereof. According to the embodiment illustrated in FIG. 2, the thrust elements 12 have, for this purpose, a top part 14 with feet 15 adjoining at the bottom, the bottom ends of the feet 15 being connected in the aforementioned manner to the tensile member 11 at the sections 13. A respective contact surface 18, 19 is formed on the top part 14 of each thrust element 12, on the sides thereof located opposite one another in the longitudinal direction of the tensile member 11, the thrust elements 12 coming into abutment, by way of the respective contact surfaces 18 and 19, with the corresponding contact surfaces 18 and 19, respectively, of the adjacent thrust elements 12 in a predetermined curved position of the tensile member 11. In the illustrated exemplary embodiment, the linear alignment of the tensile member 11 is provided as the predetermined curved position, this linear alignment corresponding to a conventional load-bearing position of a bearing bar for accommodating a sheet pile. If the thrust elements 12 abut one another at the contact surfaces 18 and 19 thereof, a transverse force acting on the bearing bar by way of the thrust elements 12, due to the butting of the thrust elements 12 against one another, merely results in a deflection of the bearing bar 10, as would occur, for example, in the case of a solid bearing bar. If, however, loading is applied from the opposite side, i.e., from below, according to FIG. 2, a curvature in the tensile member 11 results, in which case the thrust elements 12, which are then located on the tension side, move out of the abutment position by way of the contact surfaces 18 and 19 thereof.

Figure 4:
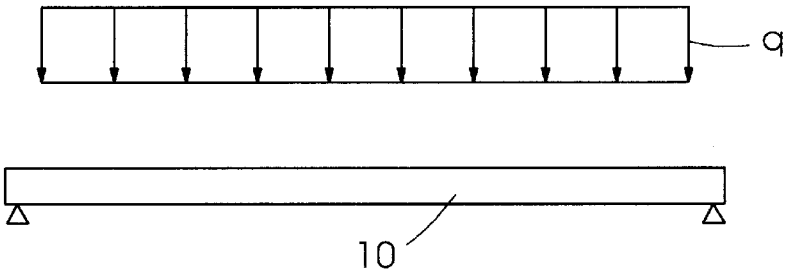
FIG. 4 is a diagrammatic illustration of the deformation behavior of the bearing bar when subjected to loading from above.
Figure 5:
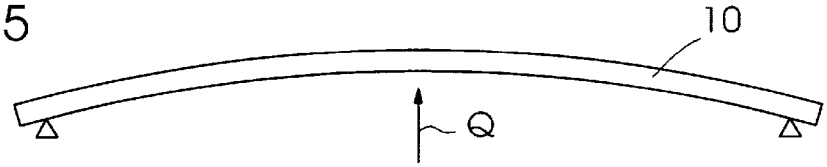
FIG. 5 is a diagrammatic illustration of the deformation behavior of the bearing bar when subjected to transverse force applied from below.

This manner of functioning of the bearing bar, which is deflectable or bendable on one side, is also illustrated, once again by way of example, in FIGS. 4 and 5. Accordingly, the bearing bar 10, which is only diagrammatically represented, is carried by a respective support at each end of the bearing bar 10. At the instant of time that the sheet pile is placed on the bearing bar 10, on the side of the thrust elements, the area load q shown in FIG. 4 takes effect, the load resulting only in very slight deformation, if any at all, of the bearing bar 10, because the loading is borne via inner stressing. In this regard, the thrust elements are located in the compressive region of the cross section of the bearing bar 10, and obstruct the deflection or bending of the belt.

If, in contrast, loading is applied from the underside of the bearing bar 10, as is represented diagrammatically in FIG. 5, the thrust elements are located in the tensile region of the cross section of the bearing bar 10 and cannot absorb the tensile forces occurring there. In this case, the deformation behavior of the bearing bar 10 is determined virtually solely by the tensile member 11, which is of flexurally soft construction and, accordingly, is deflected or bent to a great extent.

As FIG. 2 shows, it is possible to arrange a tensioning cable 16, which extends through the thrust elements 12, parallel to the longitudinal direction of the tensile member 11, and at a predetermined distance therefrom. Provided, for this purpose, in the feet 15 of the thrust elements 12 are through-boreholes 17, through which the tensioning cable 16 is guided. The tensioning cable 16 is fastened on an otherwise non-illustrated thrust element 12 on the front end of the bearing bar 10. The opposite end of the tensioning cable 16 is connected, at the rear end of the bearing bar 10, to a non-illustrated tensioning or stressing device, via which it can be subjected to tensile stressing. The tensioning cable 16 and the stressing or tensioning device are constructed so that the bearing bar 10 can be prestressed or pretensioned into the predetermined load-bearing position.

By the stressing or tensioning resulting from the use of the tensioning cable 16, the distribution of stress in the bearing bar 10, in comparison with a bearing bar without a tensioning cable, is changed so that the tensile loading of the tensile member 11 is reduced, while the compressive loading of the thrust elements 12 is increased. In this way, it is possible for the tensile member 11 to be of more flexible construction, while it is possible to compensate for the higher compressive loading of the thrust elements 12 by a correspondingly larger cross-sectional surface area of the thrust elements 12.

The bearing bar 10 also has an extensible protective sheath 20 with a U-shaped cross section which opens downwardly. The protective sheath 20 covers the top side and the lateral sides of the thrust elements 12 and thus prevents dirt from penetrating between the thrust elements 12. As can best be seen from FIG. 3, in order to fasten the protective sheath 20 on the thrust elements 12, the latter are provided on the sides thereof, in the vicinity of the tensile member 11, with grooves 21, which extend in the longitudinal direction of the tensile member 11, protrusion sections 22, which are formed at the free ends of the U-shaped cross section of the protective sheath 20, engage in the grooves 21. The surface of the protective sheath 20 which is directed towards the tensile member 11, and the surface of the tensile member 11 which is directed away from the thrust elements 12 are of the smoothest possible shape, thereby facilitating the drawing out of the bearing bar 10 arranged between two sheet piles, during a sheet-pile change.

Figure 6:
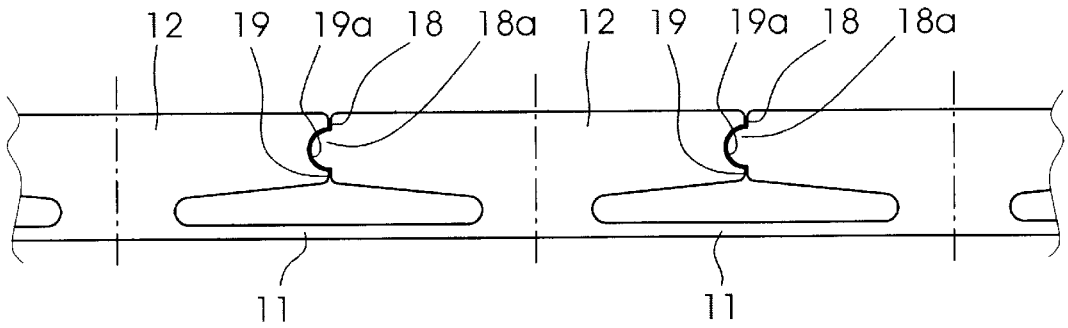
FIG. 6 is a view like that of FIG. 2 of another embodiment of the bearing bar, with an alternative construction of the contact surfaces of the thrust elements.

Whereas the contact surfaces 18 and 19 in the exemplary embodiment illustrated in FIG. 2 are of virtually planar form, FIG. 6 shows a further development of the thrust elements 12, the contact surfaces 18 and 19 of adjacent thrust elements 12 engaging within one another in a formlocking manner. In this regard, it is noted that a formlocking connection is one which connects two elements together due to the shape of the elements themselves, as opposed to a forcelocking connection, which locks the elements together by force external to the elements. For the purpose of effecting this formlocking connection, an engagement part 18*a* which projects like a head is formed on one contact surface 18, while the other contact surface 19 has a recess 19*a* of complementary shape. As FIG. 6 shows, the engagement part 18*a* and the recess 19*a* engage inside one another with a close fit in the predetermined load-bearing position of the bearing bar 10, with the result that, in this position, on the thrust elements 12, it is possible to transmit and absorb not only compressive forces directed in the longitudinal direction of the bearing bar 10 but also transverse forces, which may be larger than the frictional forces produced by the compressive forces. Furthermore, the engagement part 18*a* and the recess 19*a* form a guide for the movement of adjacent thrust elements 12 relative to one another during the deformation of the bearing bar 10.

Figure 7:
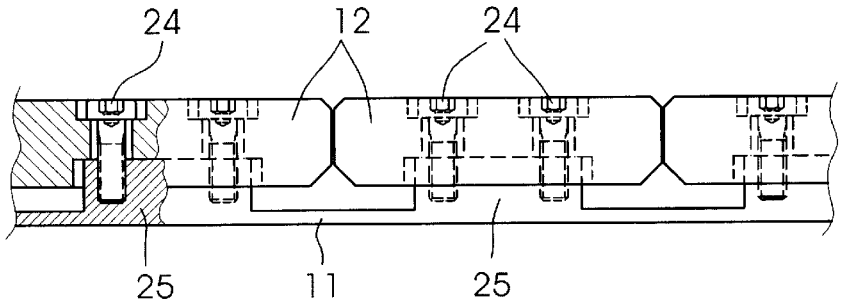
FIG. 7 is a view like that of FIG. 6, partly broken away and in section, of a further embodiment of the bearing bar, showing the thrust elements being applied to a tensile member in a releasable and adjustable manner.

FIG. 7 shows an alternative configuration in terms of the application of the thrust elements 12 to the tensile member 11. In this case, the thrust elements 12 are constructed as blocks which can be applied to bearing parts 25 of the tensile member 11 via a screw-connection with screws 24. In this regard, a central factor is that the thrust elements 12 can be secured in different positions in the longitudinal direction of the tensile member 11 via slots, with the result that the arrangement relative to one another of the contact surfaces 18 and 19, respectively, coming into mutual contact, is adjustable.

Figure 8:
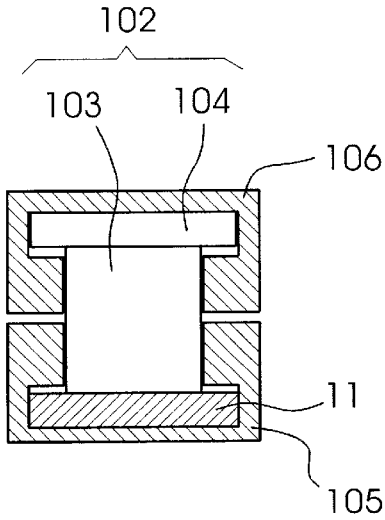
FIG. 8 is a cross-sectional view of an added embodiment of the bearing bar.

The further embodiment of the bearing bar which is shown in FIG. 8 differs from the first embodiment according to FIGS. 1 to 3 in particular in terms of the construction of the thrust elements and of the protective sheath. As FIG. 8 shows, the thrust elements 102 have a substantially T-shaped cross section which includes a web section 103, which is connected to the tensile member 11 and is of a smaller width than the tensile member 11, and a top flange 104, which is provided on that side of the web section 103 which is directed away from the tensile member 11 and which is of a width corresponding approximately to the width of the tensile member 11. In order to protect against the penetration of dirt, two protective sheaths 105 and 106 are provided, respectively, having a U-shaped cross section and being drawn inwardly at the free ends thereof to the extent at which the protective sheath 105 accommodates, in the interior thereof, the tensile member 11 and the bottom region of the web section 103, and the top sheath 106 accommodates in the interior thereof, the top-flange section 104 and the top region of the web section 103. The extensible protective sheaths 105 and 106 may thus encapsulate the entire bearing bar 10, and protect the latter against penetration by dirt.

Figure 9:
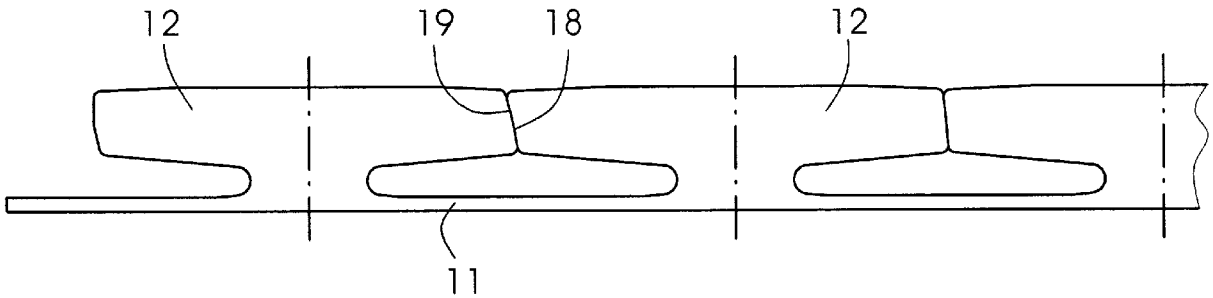
FIG. 9 is a fragmentary side elevational view of a bearing bar, namely, an end section thereof, having contact surfaces according to one development, with a view of transverse forces acting upon the bearing bar, when it is installed as intended.

In a configuration which can be seen from FIG. 9, the contact surfaces 18 and 19, respectively, of the thrust elements 12 located in a respective end region of the bearing bar 10 are constructed so that the ends thereof which are directed towards the tensile member 11 are closer to the center of the bearing bar 10 than the ends thereof which are directed away from the tensile member 11. This proves advantageous, in particular, when the normal forces produced on the contact surfaces 18 and 19, under the loading of the bearing bar 10, by a sheet pile set down on the bearing bar 10 substantially centrally between each support for the bearing bar 10, result in frictional forces which are smaller than the transverse forces produced by the loading, the magnitudes of which increase in this case, starting from the center of the bearing bar 10 in the direction towards a respective support in a respective end region of the bearing bar 10, until the respective support force has been reached.

The inclination of a respective pair of contact surfaces 18 and 19, in this regard, is preferably selected so that, with a planar configuration of the contact surfaces, the latter are located at least substantially perpendicularly to the resultants of the compressive forces which are produced by the weight of the sheet piles set down on the bearing bar 10, and act between the thrust elements 12, on the one hand, and transverse forces acting on the bearing bar 10, on the other hand.

Allowance is preferably made for the increase in the transverse forces in the direction towards a respective end of the bearing bar 10, with the simultaneous decrease in the aforementioned normal forces, in that those contact surfaces 18 and 19, respectively which are closer to a respective end of the bearing bar 10 are inclined to a more pronounced extent than the contact surfaces 18 and 19, respectively, which are farther away from the respective end.

Figure 10:
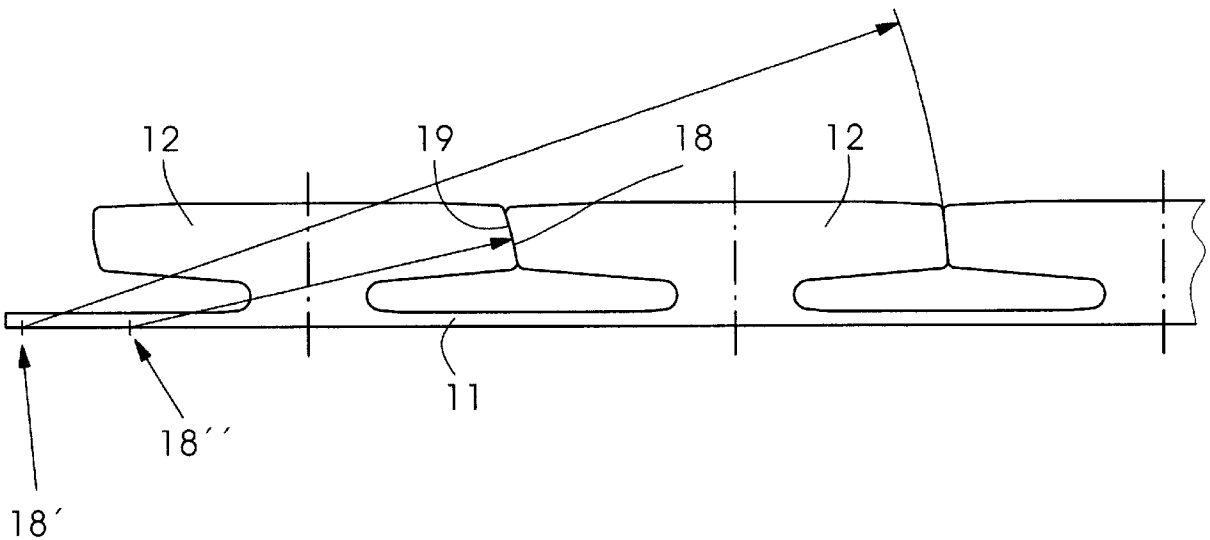
FIG. 10 is a view corresponding to that of FIG. 9, showing an alternative contact-surface configuration to that of FIG. 9.

In an alternative configuration according to FIG. 10, the contact surfaces 18 and 19, respectively, of the thrust elements 12 located in a respective end region of the bearing bar 10 are curved so that, as seen from a bearing-bar end associated with the end region, in a position thereof wherein the tensile member 11 forms an underside of the bearing bar 10, they are curved concavely downwardly from the top side of the bearing bar 10.

In preferred configurations thereof, the curved contact surfaces 18 and 19, respectively, are arranged analogously to the planar contact surfaces 18 and 19, respectively, represented in FIG. 9. In this respect, the curved contact surfaces are inclined so that the ends thereof which are directed towards the tensile member 11 are closer to the center of the bearing bar 10 than the ends thereof which are directed away from the tensile member 11 and, in a further configuration, those curved and inclined contact surfaces 18 and 19, respectively, which are closer to a respective end of the bearing bar 10 are inclined to a more pronounced extent than those which are farther away from the respective end.

The curved contact surfaces 18 and 19, respectively, of the configurations described thus far, furthermore, preferably constitute lateral-surface sections of imaginary cylinders, it further being the case, as far as the bending behavior of the bearing bar 10 is concerned, that a respective imaginary cylinder has a cylinder axis 18', 18" which is located in or approximately in the region of that side of the tensile member 11 which is directed away from the thrust elements 12.

We claim:

1. A flexible bearing bar comprising:

a flexurally soft tensile member; and thrust elements disposed successively in series on one side of said tensile member, said thrust elements being formed with respective contact surfaces, said contact surfaces being in contact with one another upon subjecting said thrust elements to a load in a direction from said thrust elements towards said tensile member, said contact surfaces not being in contact with one another upon subjecting said thrust elements to a load in a direction from said tensile member towards said thrust elements.

2. The bearing bar according to claim 1, wherein said tensile member is a belt.

3. The bearing bar according to claim 1, wherein said thrust elements are formed integrally with said tensile.

4. The bearing bar according to claim 1, wherein said thrust elements are fastened to said tensile member.

5. The bearing bar according to claim 4, wherein said thrust elements are fastened adjustably to said tensile member.

6. The bearing bar according to claim 5, wherein said thrust elements are securable in different positions in a longitudinal direction of said tensile member.

7. The bearing bar according to claim 1, including a tensioning device for bracing said thrust elements against one another.

8. The bearing bar according to claim 7, wherein said tensioning device has a tensioning cable extending through through-passages formed in said thrust elements.

9. The bearing bar according to claim 1, including a protective sheath for covering said thrust elements.

10. The bearing bar according to claim 9, wherein said protective sheath is extensible.

11. The bearing bar according to claim 1, including a protective sheath for covering said tensile member.

12. The bearing bar according to claim 11, wherein said protective sheath is extensible.

13. The bearing bar according to claim 1, wherein said thrust elements engage with one another in a formlocking manner on said contact surfaces thereof.

14. The bearing bar according to claim 13, including an engagement part formed on one of said contact surfaces and engageable in a recess formed in another contact surface associated therewith.

15. The bearing bar according to claim 1, wherein respective contact surfaces of the thrust elements located in a respective end region of the bearing bar are planar and are inclined so that the ends thereof which are directed towards said tensile member are closer to a center of the bearing bar than the ends thereof which are directed away from said tensile member.

16. The bearing bar according to claim 15, wherein those of said contact surfaces which are closer to a respective end of the bearing bar are inclined to a more pronounced extent than those of said contact surfaces which are farther away from the respective end.

17. The bearing bar according to claim 1, wherein those of said contact surfaces of the thrust elements located in a respective end region of the bearing bar are curved so that, as viewed from a bearing-bar end associated with the end region, in a position thereof wherein the tensile member forms an underside of the bearing bar, they are curved concavely downwardly from the top side of the bearing bar.

18. The bearing bar according to claim 17, wherein said curved contact surfaces are inclined so that the ends thereof which are directed towards said tensile member are closer to a center of the bearing bar than the ends thereof which are directed away from said tensile member.

19. The bearing bar according to claim 18, wherein those curved and inclined contact surfaces which are closer to a respective end of the bearing bar are inclined to a more pronounced extent than those which are farther away from the respective end.

20. The bearing bar according to claim 17, wherein said curved contact surfaces constitute lateral-surface sections of imaginary cylinders.

21. The bearing bar according to claim 20, wherein a respective one of said imaginary cylinders has a cylinder axis which is located at least approximately in a region of that side of said tensile member which is directed away from said thrust elements.

22. The flexible bearing bar according to claim 1, wherein said tensile member is supported by two supports.

* * * * *